US005873795A

United States Patent [19]

Wozny et al.

[11] Patent Number: 5,873,795

[45] Date of Patent: Feb. 23, 1999

[54] IRON-TYPE GOLF CLUBHEAD WITH OPTIMIZED POINT OF LEAST RIGIDITY

[75] Inventors: Thomas Wozny, Mt. Prospect; Mark Chesney, Evanston; Jon Pergande, Des Plaines, all of Ill.

[73] Assignee: Wilson Sporting Goods Co., Chicago, Ill.

[21] Appl. No.: 785,889

[22] Filed: Jan. 21, 1997

[51] Int. Cl.[6] ..... A63B 53/04

[52] U.S. Cl. ..... 473/350; 473/346

[58] Field of Search ..... 473/350, 349, 473/346, 345, 342, 334, 329, 290, 291, 337

[56] References Cited

U.S. PATENT DOCUMENTS

| | | | |
|---|---|---|---|
| 4,715,601 | 12/1987 | Lamanna | 473/291 |
| 4,754,977 | 7/1988 | Sahm | 473/337 |
| 5,046,733 | 9/1991 | Antonious | 473/350 |
| 5,048,835 | 9/1991 | Gorman | 473/350 |
| 5,328,184 | 7/1994 | Antonious | 473/346 |
| 5,333,872 | 8/1994 | Manning et al. | 473/350 |
| 5,547,194 | 8/1996 | Aizawa et al. . | |
| 5,586,947 | 12/1996 | Hutin | 473/350 |

FOREIGN PATENT DOCUMENTS

| | | |
|---|---|---|
| 2117254 | 3/1983 | United Kingdom . |
| WO 93/20904 | 10/1993 | WIPO . |

*Primary Examiner*—Steven Wong

[57] ABSTRACT

A cavity backed iron-type clubhead has a striking plate which has a point of least rigidity which is generally aligned with the center of gravity of the clubhead. The striking plate is formed between the front face of the clubhead and the back wall of the cavity. The point of least rigidity of the striking plate is adjusted by a rigidifying member on the back wall of the cavity which increases the thickness of the striking plate. The back wall may also include a rearwardly extending projection which is generally aligned with the center of gravity of the clubhead.

16 Claims, 5 Drawing Sheets

IRON-TYPE GOLF CLUBHEAD WITH OPTIMIZED POINT OF LEAST RIGIDITY

BACKGROUND

This invention relates to golf clubheads, and, more particularly, to an iron-type golf clubhead with a back cavity.

There has been a trend in recent years in the golf club industry for irons to be made oversized with a large cavity-backed face for striking a golf ball. The thin striking plate which is formed between the front striking face and the back wall of the cavity has a point of least rigidity (POLR) where the least support occurs behind the face. This point will deflect the most when it impacts a golf ball, and we believe that impacting a golf ball at the point of least rigidity will impart the greatest velocity to the golf ball, resulting in maximum distance for the flight of the ball.

For oversized golf clubs, the point of least rigidity or POLR of the face tends to be offset from the center of the face, usually toward the high toe portion of the face. However, this high toe area of the face is generally not functional since it is not used to impact a golf ball. The high toe location of the POLR might be the reason, in part, why some golfers hit the ball farther off of a tee than off the fairway and why "flyers" are sometimes hit out of the rough. In both cases the ball is impacted higher on the face and closer to the POLR of the face.

SUMMARY OF THE INVENTION

The invention shifts the POLR of the face so that it is generally aligned with the center of the face or the center of gravity of the clubhead. The POLR is shifted away from the high toe area toward the center of the face by attaching an insert to the back cavity, usually in the high toe area of the cavity. The insert is preferably formed from material of lesser density than the clubhead so that the insert will not substantially change the center of gravity of the clubhead. The shape, size, and position of the insert tunes the rigidity of specific portions of the face and positions the POLR in the desired location.

The POLR can also be shifted by making specific portions of the face, usually the high toe portion, thicker. Or a combination of a thicker face portion and an insert could be used.

The thickness of the face can also be increased in the central area of the face in order to increase the size of an area which has a substantially uniform rigidity. Although increasing the thickness of the center of the face increases the rigidity at the center, an area which surrounds the center will have substantially the same rigidity and will provide substantially consistent ball response when the ball is impacted within that area.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
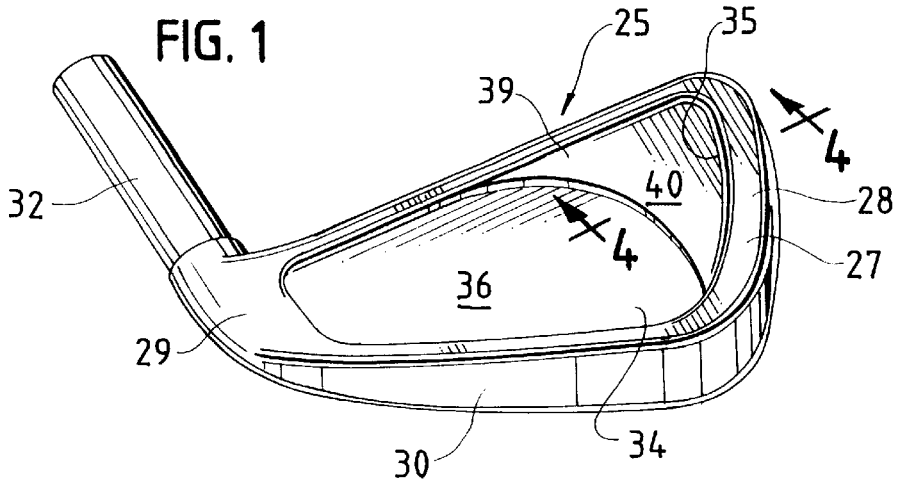
FIG. 1 is a rear view of a golf club formed in accordance with the invention.
Figure 2:
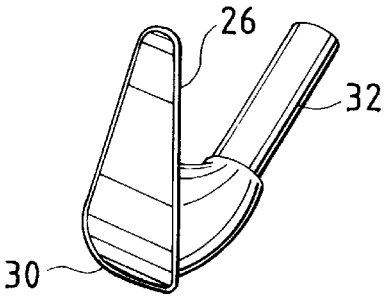
FIG. 2 is a toe end view of the clubhead.
Figure 3:
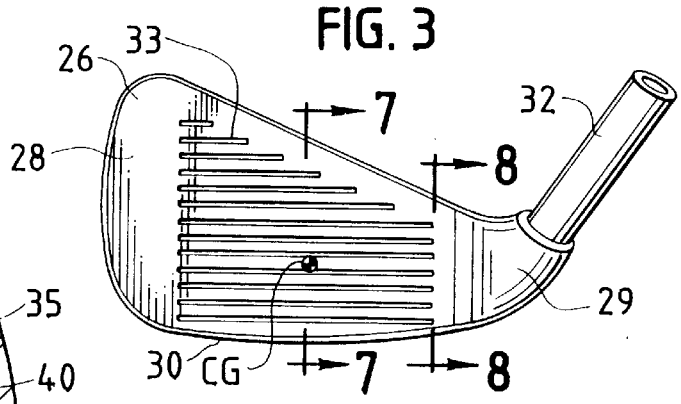
FIG. 3 is a front view of the clubhead.

Referring to FIGS. 1–4, an iron-type clubhead 25 includes a front striking face 26, a back surface 27, a toe portion 28, a heel portion 29, a sole 30, and a top edge 31. A hosel 32 extends upwardly from the heel portion. The face is provided with conventional grooves 33.

A cavity 34 is formed in the back of the clubhead and is defined by side wall 35 and a back wall 36. The back wall 36 of the cavity extends substantially parallel to the face 26 (FIGS. 7 and 8), and a thin striking plate 37 is formed by the cavity back wall 36 and the face 26 inside of the cavity side wall 35.

The upper toe portion of the striking plate is rigidified by a rigidifying member 39. The rigidifying member has a back surface 40 which is positioned rearwardly of the back wall 36 in the remainder of the cavity.

Figure 4:
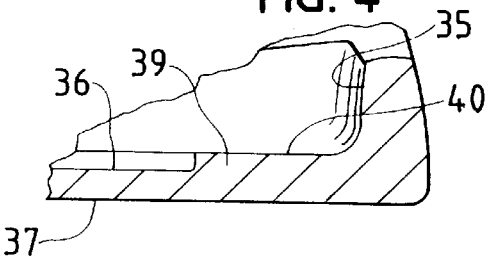
FIG. 4 is a fragmentary sectional view taken along the line 4—4 of FIG. 1.

Referring to FIG. 4, one embodiment of the rigidifying member 39 is integrally formed on the clubhead by a rearwardly stepped portion of the back wall of the cavity. The thickness of the striking plate is increased by the stepped portion.

Figure 5:
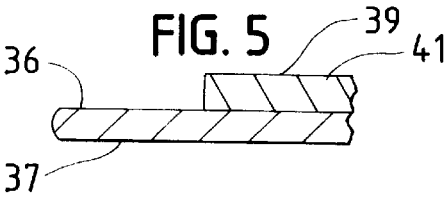
FIG. 5 is a view similar to FIG. 4 showing another embodiment of a POLR-shifting insert.

FIG. 5 illustrates another embodiment of the rigidifying member 39 which is formed by a separate insert 41 which is attached to the back wall 36 of the cavity. The insert can be attached by epoxy, adhesive, welding or the like. The insert material is preferably less dense than the material of the clubhead, which may be stainless steel, beryllium copper, nickel, or other conventional clubhead material. One specific embodiment of the insert was made from aluminum because of its low density and high strength. The aluminum insert ridigifies the striking plate without substantially changing the location of the center of gravity.

Figure 6:
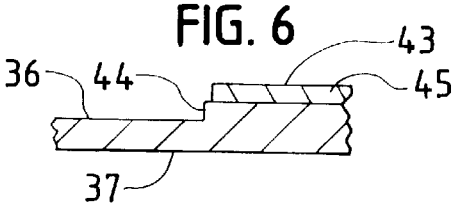
FIG. 6 is a view similar to FIGS. 4 and 5 showing still another embodiment of a POLR-shifting insert.

FIG. 6 illustrates a modified rigidifying member 43 which is formed by a combination of an integrally formed stepped portion 44 of the back wall 36 and a separate insert 45 which is attached to the stepped portion by epoxy or the like.

Without the rigidifying member the POLR of the striking plate would not be aligned with the center of gravity CG (FIGS. 3 and 7) of the clubhead. Most clubheads are designed so that the center of gravity is positioned behind the face and in a vertical plane which extends perpendicularly through the midpoints of the grooves 33 when the club is properly soled on a horizontal ground plane. The grooves 33 extend parallel to the horizontal ground plane. Such a vertical plane may be referred to as the vertical midplane and is aligned with the line 7—7 of FIG. 3.

Figure 7:
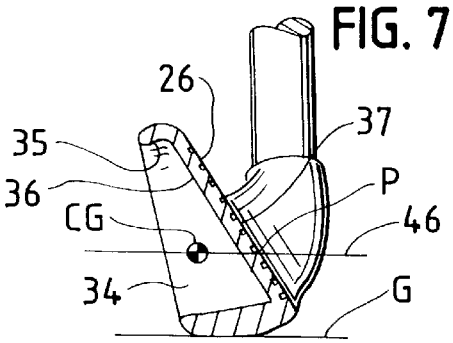
FIG. 7 is a fragmentary sectional view taken along the line 7—7 of FIG. 3.
Figure 8:
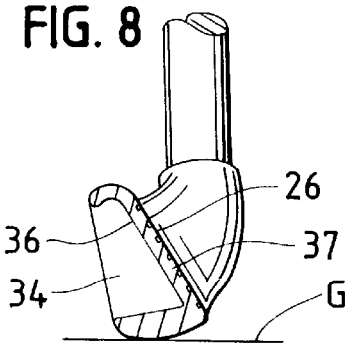
FIG. 8 is a fragmentary sectional view taken along the line 8—8 of FIG. 3.
Figure 9:
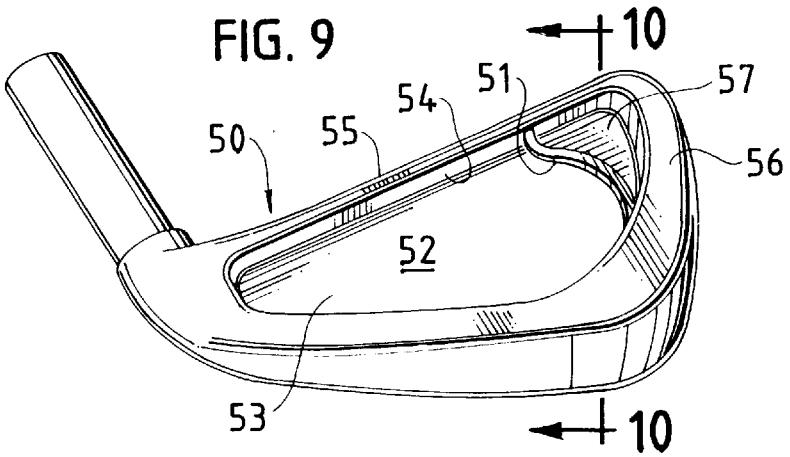
FIG. 9 is a rear view of a clubhead in which the back wall of the cavity is provided with a ridge for retaining an insert.
Figure 10:
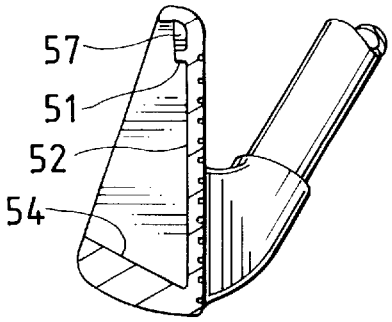
FIG. 10 is a fragmentary sectional view taken along the line 10—10 of FIG. 9.

Referring to FIG. 7, when the club is soled on the ground plane G and the hosel is in a vertical plane which extends perpendicularly to the midplane, a horizontal line 46 which extends through the center of gravity and which lies in a plane which is perpendicular to the face intersects the face at a point P. The point P is the optimum impact point for the golf ball. A more detailed discussion of the various angles and planes which are conventionally used in club design may be found in U.S. Pat. No. 5,105,550.

The size, shape, and location of the rigidifying member for the face plate is selected so that the POLR of the face plate is shifted into substantial alignment with the center of gravity along the line 46, i.e., a horizontal line which lies in a first vertical plane which extends perpendicularly to the face when the clubhead is soled on a horizontal ground plane and the hosel lies in a second vertical plane which is perpendicular to the first vertical plane. Alignment with the center of gravity as used herein refers to said horizontal line 46 and its point of intersection P on the face.

FIGS. 9–13 illustrate a modified clubhead 50 which is similar to the clubhead 25. However, a ridge or fence 51 is integrally formed with the back wall 52 of the cavity 53. The ridge extends from the cavity side wall 54 adjacent the top edge 55 to the cavity side wall which extends along the toe 56.

The ridge forms a recess 57 in the upper toe area of the cavity, and an insert 58 (FIGS. 11 and 12) is secured within the recess by epoxy or the like. The insert is provided with an undercut 59 which abuts the ridge 51 and which forms a shoulder 60 which extends over the ridge.

Figure 11:
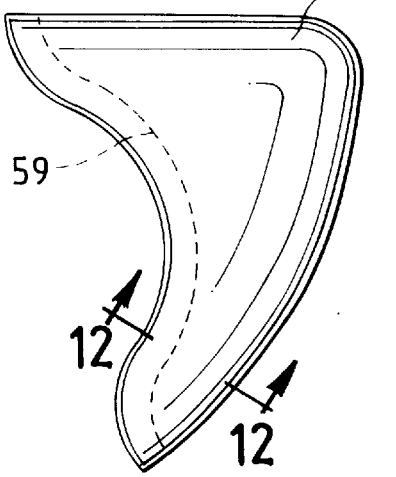
FIG. 11 is an enlarged rear view of an insert for the clubhead of FIG. 9.
Figure 12:
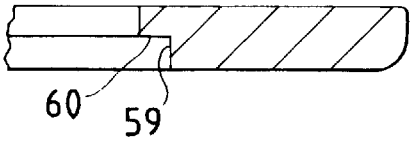
FIG. 12 is a fragmentary sectional view taken along the line 12—12 of FIG. 11.
Figure 13:
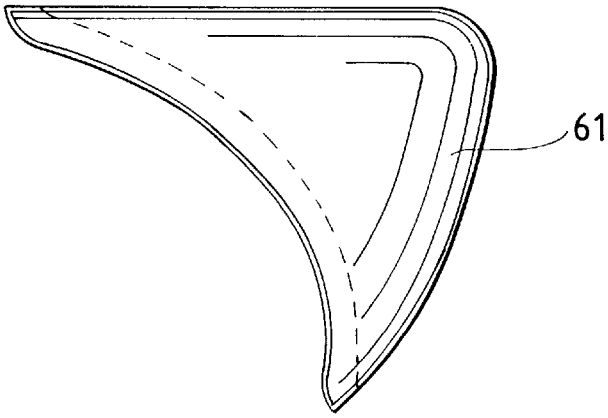
FIG. 13 is a view similar to FIG. 11 of another shape of insert.
Figure 14:
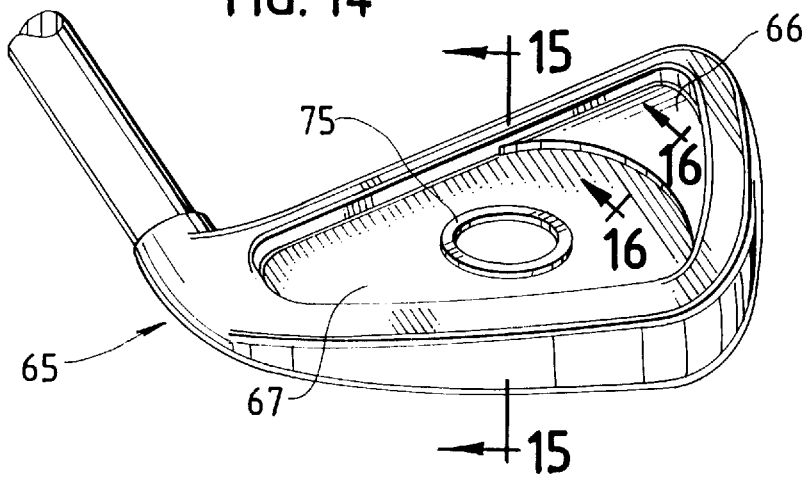
FIG. 14 is a rear view of a modified embodiment of a clubhead in accordance with the invention.

The insert 58 shown in FIG. 11 is designed for use in higher lofted clubs, for example, No. 7 through pitching wedge. The insert 61 shown in FIG. 13 is designed for lower lofted clubs, for example, Nos. 1 through 6.

The ridge 51 acts as a guide for positioning the insert and holds the insert securely against the side wall of the cavity. We believe that the insert will be more securely retained in the cavity with the ridge than without the ridge. In one specific embodiment the insert was formed from aluminum and was 0.187 inch thick.

Figure 15:
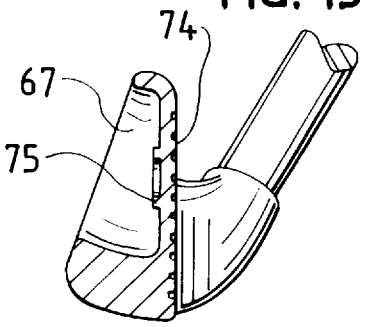
FIG. 15 is a fragmentary sectional view taken along the line 15—15 of FIG. 14.
Figure 16:
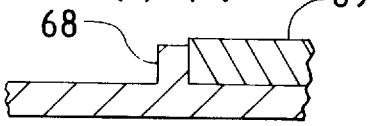
FIG. 16 is a fragmentary sectional view taken along the line 16—16 of FIG. 14.
Figure 17:
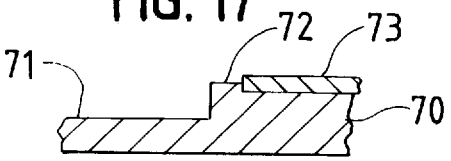
FIG. 17 is a view similar to FIG. 16 showing an alternate embodiment.

FIGS. 14–17 illustrate a clubhead 65 which is similar to the clubheads 25 and 50. The clubhead 65 includes a rigidifying member 66 in the high toe area of the back cavity 67. The rigidifying member can be any of the embodiments which have been previously described. For example, FIG. 16 illustrates a rigidifying member which includes a ridge 68 similar to the ridge 51 and a separate insert 69. FIG. 17 illustrates an integral stepped portion 70 of the back wall 71, an integral insert-retaining ridge 72, and a separate insert 73.

In specific embodiments of the clubheads, the thickness of the striking plate, e.g., 37 in FIGS. 4–8, was at least about 0.100 inch. The thickness of the striking plate is measured where there is no insert or rigidifying member in the back cavity. The total thickness of the clubhead in the area of the rigidifying member 39 was about 0.163 inch. In FIG. 5 the thickness of the insert 41 was about 0.125 inch.

In FIG. 6 the combined thickness of the striking plate 37 and the stepped portion 44 was about 0.162 inch, and the thickness of the insert 45 was about 0.063 inch.

In FIG. 15 the total thickness of the striking plate and the ridge 68 was about 0.200 inch, and the thickness of the insert 69 was about 0.125 inch. In FIG. 17, the combined thickness of the striking plate and the ridge 72 was about 0.200 inch, the total thickness of the stepped portion 70 was about 0.162 inch, and the thickness of the insert 73 was a bout 0.063 inch. The foregoing dimensions are subject to normal casting or forging tolerances.

The rigidifying member repositions the POLR of the striking plate 74 so that the POLR is substantially aligned with the center of gravity of the clubhead. However, the POLR is by definition a point or small area on the face, and the rigidity of other portions of the face is greater. Since it is difficult to impact a golf ball at a precise point on the face, it is desirable to provide a discrete area on the face which has substantially constant rigidity in order to provide consistent ball response when the ball is impacted anywhere within the discrete area.

The clubhead 65 is provided with a rearwardly extending projection 75 in the central portion of the back cavity 67. The projection is generally aligned with the center of gravity of the clubhead and increases the rigidity of the striking plate at that point so that a discrete area on the face which surrounds the point of alignment with the center of gravity has substantially the same rigidity. However, the rigidity of the face within that area is still less than the rigidity of the face outside of that area.

The particular projection 75 which is illustrated is formed integrally with the back wall of the cavity. The total thickness of the striking plate and the clubhead is about 0.160 inch. The projection can also be separately formed and attached by epoxy, welding, etc.

The shape of the projection which is illustrated is an elliptical ridge. However, the projection can be solid or can have other shapes. For example, the projection can form a logo design within the cavity.

Figure 18:
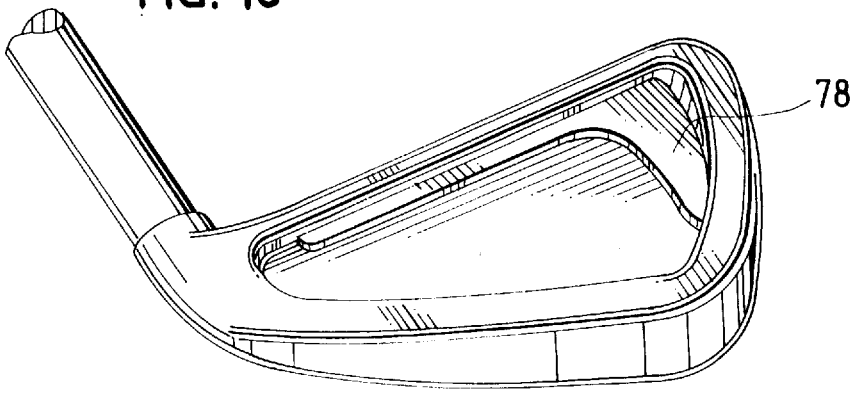
FIGS. 18 through 20 illustrate other shapes of POLR-shifting inserts.
Figure 19:
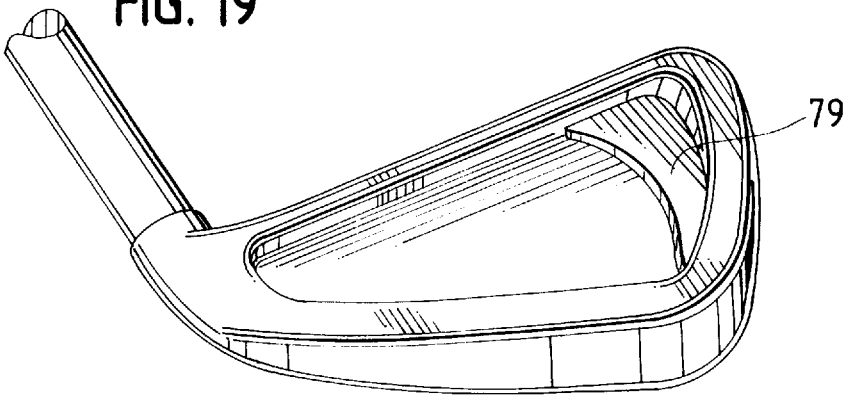
Figure 20:
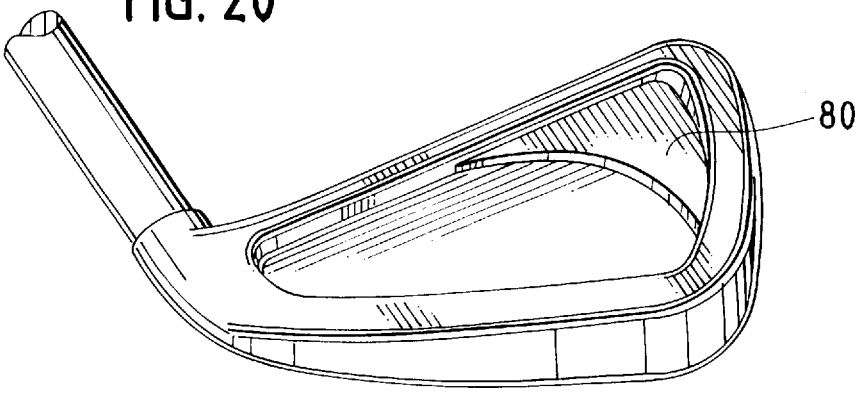
Figure 21:
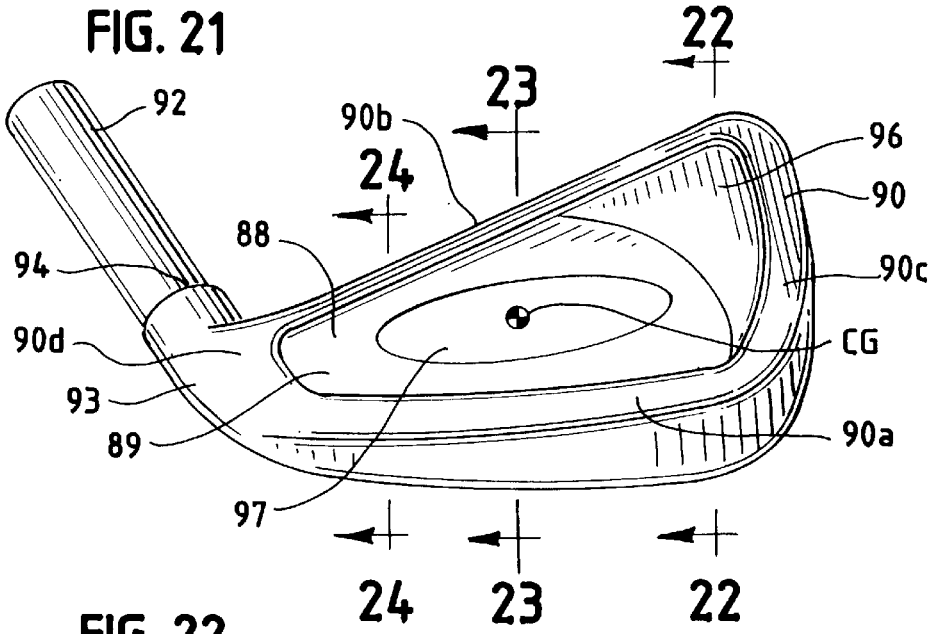
FIG. 21 is a view similar to FIGS. 1 and 14 of another embodiment of a clubhead formed in accordance with the invention.
Figure 22:
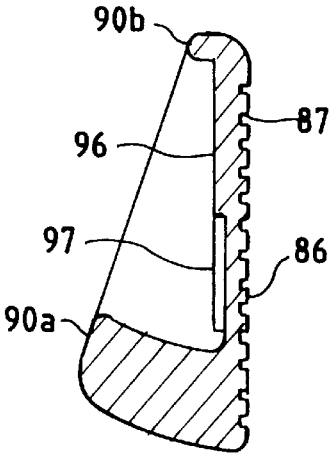
FIG. 22 is a sectional view taken along the line 22—22 of FIG. 21.
Figure 23:
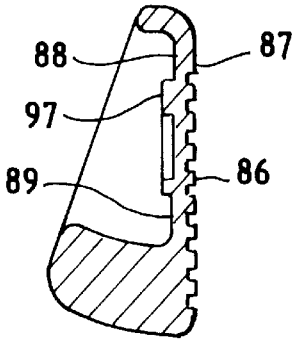
FIG. 23 is a sectional view taken along the line 23—23 of FIG. 21.
Figure 24:
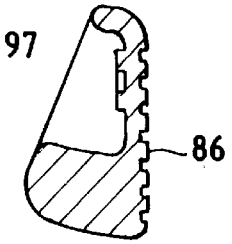
FIG. 24 is a sectional view taken along the line 24—24 of FIG. 21.
Figure 25:
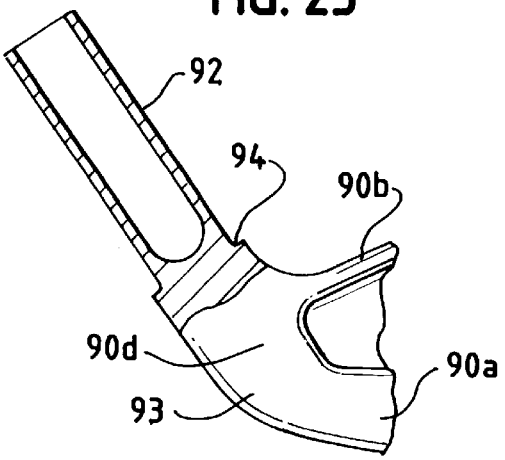
FIG. 25 is a fragmentary sectional view of the hosel of the clubhead of FIG. 21.

FIGS. 18–20 illustrate additional shapes of rigidifying members. In FIG. 18 the rigidifying member 78 is positioned not only in the high toe area of the cavity but also extends along most of the top portion of the side wall. In FIG. 19 the rigidifying member 79 extends downwardly into the low toe area of the cavity. In FIG. 20 the rigidifying member 80 extends along substantial portions of the cavity side wall which extend adjacent the top edge and the toe.

The size, shape, and position of the rigidifying member is selected as desired to "tune" the rigidity of the striking plate and to reposition the POLR to the area which the club designer desires.

FIGS. 21–25 illustrate the currently preferred embodiment of a clubhead in accordance with the invention. The clubhead 85 is similar to the clubheads previously described and includes a relatively thin striking plate 86 formed by a face 87 and a back wall 88. A back cavity 89 is defined by the back wall and by a rearwardly extending peripheral wall 90. The sole portion 90*a* of the peripheral wall extends substantially beyond the top line portion 90*b* of the peripheral wall. The toe and heel portions 90*c* and 90*d* of the peripheral wall extend between the sole and topline portions.

A tubular hosel 92 extends from the heel portion 93 of the clubhead. The hosel includes an annular shoulder 94 which provides a stop for a golf shaft which fits over the tubular hosel.

A rigidifying member 96 extends rearwardly from the upper toe portion of the cavity back wall and extends along the top portion 90*b* and toe portion 90*c* of the peripheral wall 90. In the preferred embodiment the thickness of the striking plate 86 was about 0.100 inch, and the rigidifying member 96 added an additional thickness of about 0.050 inch, i.e., the back surface of the rigidifying member was spaced about 0.050 inch behind the back surface 88 of the striking plate.

A generally elliptical projection 97 extends rearwardly from the central portion of the cavity back 88. The thickness of the projection 97 is substantially the same as the thickness of the rigidifying member 96, and the total thickness of the striking plate and projection is about 0.150 inch. A logo or other identifying indicia can be engraved in or embossed on the projection if desired.

The rigidifying member 96 and projection 97 are integrally cast with the clubhead. The rigidifying member 96 positions the POLR in general alignment with the center of the striking face and the center of gravity of the clubhead. The center of the projection 97 is generally aligned with the center of the striking face and the center of gravity CG. The projection provides a substantial area on the striking plate which has substantial uniform rigidity and which provides substantially consistent ball response when a golf ball is impacted within that area.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. An iron-type clubhead having a front striking surface, a back portion, a toe portion, a heel portion, a top edge, and a sole, the back portion having a back surface and a cavity in the back surface which is formed by a side wall which extends rearwardly from the front striking surface and a back wall which extends from the side wall generally parallel to the front striking surface, the front striking surface and the back wall of the cavity forming a striking plate therebetween, the clubhead having a center of gravity and the striking plate having a point of least rigidity, and a rigidifying member on a portion of the back wall which is sized and positioned to align the point of least rigidity with the center of gravity of the clubhead.

2. The clubhead of claim 1 in which the rigidifying member comprises an insert secured to the back wall of the cavity, the insert being formed of a material which is less dense than the material of the clubhead.

3. The clubhead of claim 2 in which the insert is secured to the back wall of the cavity in the toe portion of the clubhead and adjacent the top edge of the clubhead.

4. The clubhead of claim 2 in which the insert is aluminum.

5. The clubhead of claim 2 in which the back wall of the cavity includes a rearwardly stepped portion to which the insert is attached and which provides the striking plate with a thicker portion.

6. The clubhead of claim 2 in which the back wall of the cavity includes a rearwardly extending ridge which forms a recess between the ridge and the side wall of the cavity, the insert being positioned within the recess.

7. The clubhead of claim 6 in which the back wall of the cavity includes a rearwardly stepped portion within the recess which provides the striking plate with a thicker portion.

8. The clubhead of claim 7 in which the insert is aluminum.

9. The clubhead of claim 6 in which the insert is aluminum.

10. The clubhead of claim 2 in which the back wall of the cavity includes a rearwardly projecting rigidifying portion within a central portion of the cavity for increasing the area of the point of least rigidity.

11. The clubhead of claim 10 in which the rearwardly projecting portion of the back wall surrounds the center of gravity of the clubhead.

12. The clubhead of claim 1 in which the rigidifying member comprises a rearwardly stepped portion on the back wall which is integrally formed with the back wall.

13. The clubhead of claim 12 in which the rearwardly stepped portion on the back wall is in the toe portion of the clubhead adjacent the top edge of the clubhead.

14. The clubhead of claim 12 in which the back wall of the cavity includes a rearwardly projecting rigidifying portion within a central portion of the cavity for increasing the area of the point of least rigidity.

15. The clubhead of claim 14 in which the rearwardly projecting portion of the back wall surrounds the center of gravity of the clubhead.

16. The clubhead of claim 14 in which the rearwardly projecting portion is integral with the back wall.

* * * * *